US006588132B2

(12) United States Patent
Tsuji

(10) Patent No.: US 6,588,132 B2
(45) Date of Patent: Jul. 8, 2003

(54) LIGHT EMITTING DISPLAY DEVICE

(75) Inventor: Kazuyoshi Tsuji, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/862,322

(22) Filed: May 23, 2001

(65) Prior Publication Data

US 2002/0000056 A1 Jan. 3, 2002

(30) Foreign Application Priority Data

May 25, 2000 (JP) ..... 2000-154462
May 25, 2000 (JP) ..... 2000-154464

(51) Int. Cl.[7] ..... G09F 3/04; G09F 9/00
(52) U.S. Cl. ..... 40/451; 40/452; 40/448
(58) Field of Search ..... 40/451, 442, 447, 40/448, 452, 541, 542, 544, 564

(56) References Cited

U.S. PATENT DOCUMENTS 3,481,062 A * 12/1969 Du Bois, Jr. et al. ..... 40/451
3,978,599 A * 9/1976 Berger ..... 40/542
4,021,945 A * 5/1977 Sussman ..... 40/448
4,216,599 A * 8/1980 Eckert ..... 40/451
4,274,217 A * 6/1981 Ohshima ..... 40/451
4,532,579 A * 7/1985 Merryman ..... 40/576
4,724,629 A * 2/1988 Walton ..... 40/447
5,392,546 A * 2/1995 Bailey ..... 40/447
5,950,340 A * 9/1999 Woo ..... 40/564
6,314,669 B1 * 11/2001 Tucker ..... 40/452

* cited by examiner

*Primary Examiner*—S. Joseph Morano
*Assistant Examiner*—Jason R. Bellinger
(74) *Attorney, Agent, or Firm*—Morgan, Lewis & Bockius LLP

(57) ABSTRACT

A light emitting portion is formed in such a manner that LED chips 2 are provided on the one ends of the leads 1 for the respective segments of a numeral which is a part of a display image. A reflecting case in which light conducting portions are provided so as to correspond to the parts of the display image is formed so that the LED chips are encircled by the respective light conducting portions. Light permeable resin 4 is filled in the reflecting case so that the interior of the reflecting case 3 and the one ends of the plurality of leads are fixed. An uneven portion is formed at least a portion of an outer peripheral side wall of the reflecting case.

9 Claims, 7 Drawing Sheets

LIGHT EMITTING DISPLAY DEVICE

BACKGROUND OF THE INVENTION

1. Field of the Invention

This invention relates to a light-emitting display device for displaying a numeral or character in seven segments or in a dot matrix structure using light emitting elements such as LEDs, which is used for displaying an amount of money in a vending machine. More specifically, this invention relates to a light emitting display device having a simple structure which includes a lead frame or resin circuit board and a reflecting case and is difficult to produce diffraction of light due to peeling of the coating of the display surface of the reflecting case or light leakage from its rear face. Further, this invention relates to a light emitting display device whose vertical direction can be easily known when it is attached to a circuit board, thereby facilitating its mounting, and can prevent leak of light from between display devices arranged in plurality.

2. Description of the Related Art

A conventional light-emitting display device having a seven-segment structure has structured as shown in FIG. 7. In this structure, a light conducting portion constituting seven segments is formed in a reflecting case. For each segment, a light-emitting element (hereinafter referred to as "LED") not shown is die-bonded or wire-bonded onto a lead frame or resin circuit board. The light conducting portion is filled with light-permeable resin 4. The LED has an anode and cathode and hence must have two lead wires for each segment. In this case, the one lead wire for the anode or cathode may be common to the respective segments. Therefore, 8–10 lead wires (inclusive of that for a decimal point) are formed to exhibit a numeral of one digit. Namely, a plurality of lead wires 1 are provided along two long sides in a longitudinal direction (both sides in a display direction) or both upper and lower sides.

In order that the light emitted from the LED illuminates more brightly over the entire segment, the interior of the light conducting portion must be colored in whitish light-reflective color. Therefore, the reflecting case is generally made of whitish resin. Further, where the display surface is not a dark color such as black, the display color of each segment is difficult to recognize. For this reason, the surface of the reflecting case, as the case may be, the side thereof also is coated in the dark color such as black. The black coating is generally made in such a manner of drying black ink printed by screen printing.

As described above, in the light emitting display device for a numeral, its reflecting case is made of a whitish mold and the display surface is coated with a dark color such as black. However, the coating strength in the coating on the resin surface is not constant owing to the dirt of the surface state or reduction in flatness such as a projection due to a molding die. Therefore, the friction for the surface during transfer or contact therewith by handling during mounting is likely to produce scratching. Such a scratch leads to peeling of the black coating, exposes the underlying whitish resin and greatly deteriorates the appearance of the display surface.

Further, where the display is made on the arrangement of a number of units, not only the display surface but also the side surface is preferably coated with black because white on the side surface is difficult to see. However, the coating of the side surface causes the front and side surface rectangular prism to be coated by screen printing. In this case, the coating must be done for each surface. This greatly increases the number of man-hours of coating and the production cost. In addition, the problem of coating peeling still remains. Further, on the side of the bottom surface of the reflecting case, the case portion of the outer periphery and bottom surface to which a lead frame or resin circuit board portion is attached have different heights so that the entire bottom surface is not flat but complicatedly rugged. Therefore, it is very difficult to coat the bottom surface. The light which leaks toward the bottom via filled resin repeats random reflection between the whitish case of the bottom and the whitish lead frame plated with silver or resin circuit board having a metallic pattern so that light leakage occurs outside of another segment or the reflecting case. This is likely to produce erroneous exhibition. Where the reflecting case is formed of whitish resin, revived resin cannot be used since it cannot give white with high reflection coefficient. Namely, resources cannot be efficiently used.

Further, the light emitting display device for displaying numerals has the same appearance even when it is turned upside down where it has no decimal point. However, the lead connection is not necessarily symmetrical. Therefore, with its direction known correctly, the device must be mounted. In this case, since the appearance is entirely symmetrical, it is very difficult to know its direction.

In the light emitting display device such as a numeral display, a few of device units are arranged side by side to exhibit many digits. In this case, the device units must be arranged with no gap. However, for permission of the clearance during the process for manufacturing the device, and during its mounting, the gap of at least 0.1 mm or more must be given between the device units. Therefore, the gap between the adjacent device units cannot be removed completely. Meanwhile, in the light emitting display device with a reflecting case inclusive of its bottom coated with resin, the light emitted from the LED leaks to the bottom side of the reflecting case via the resin and the leaked light further leaks from the gap between the light-emitting display device units so that erroneous recognition of apparently exhibiting "1" between numerals occurs.

Further, in this kind of light emitting display device, its surface exclusive of e.g. segments of a numeral is colored in black to provide the good appearance. However, the light conducting portion in the vicinity of the LEDs is preferably colored in white to prevent absorption of light, thereby improving the display luminance. For this reason, the reflecting case is generally formed of whitish plastic and the surface of the display screen and its side surface as necessary are coated with black. On the other hand, where this light emitting display device is transferred, several tens of device units housed in a tube (stick) of plastic are transferred. In this case, at the time of taking in and out or where there is an internal clearance, the display screens of the device units are rubbed in the tube during the transfer. As a result, the coating may be peeled so that the display quality will be deteriorated.

SUMMARY OF THE INVENTION

This invention has been accomplished in order to solve the problem described above. An object of this invention is to provide a light-emitting display device which can reduce light leakage by coloring the reflecting case inclusive of the bottom in a light-absorbable color, thereby preventing erroneous exhibition.

Another object of this invention is to provide a light-emitting display device having a structure in which white is not exposed even when slight scratch is produced on the display surface so that the display surface is not spotted.

Still another object of this invention is to provide a light emitting display device having a structure in which revived resin can be used for the reflecting case.

Further, this invention has been accomplished in order to solve the above problem. An object of this invention is to provide a light emitting device whose vertical direction can be easily known.

Still yet another object of this invention is to provide a light emitting display device in which erroneous recognition of exhibition due to the leakage of light from gaps between a number of device units does not occur.

Still further object of this invention is to provide a light emitting display device in which the coating on the display screen owing to rubbing is not peeled and the display quality is not deteriorated.

Further yet another object of this invention is to provide a light emitting display device in which a plurality of the same device unit constituting a single display device such as a numeral display device can be mounted on a circuit board in a state where they have been previously arranged as necessary device units.

The light emitting display device comprises: a plurality of light-emitting elements for lighting parts of a display image, respectively; a plurality of leads to the one ends of which the light emitting elements are die-bonded or wire-bonded, respectively; a reflecting case which has light conducting areas corresponding to the parts of the display image and covers areas to be bonded; and light permeable resin filled in the reflecting case so that the light conducting portions of the reflecting case encircle the corresponding light emitting elements and the one ends of the plurality of leads are fixed. In the light-emitting display device, the reflecting case is made of resin, and the inner walls of the light conducting portions are colored in a light-reflective color whereas the remaining outer surface of the reflecting case inclusive of the bottom is colored in light-absorptive color.

Now, the display image means an image which can change the display state of a numeral, character, etc. A part of the display image means one segment in the case where e.g. a numeral is exhibited using seven segments. The light reflective color means a whitish light-reflective and blight color such as white and light gray. The light absorptive cooler means a blackish, difficult to reflect, dark color such as black and navy blue.

In accordance with this invention, the reflecting case inclusive of its bottom is colored in the light absorptive color. For this reason, even when light emitted from the LED leaks via the light-permeable resin toward the bottom of the reflecting case and reflects from the lead frame inserted on the bottom side, it is absorbed on the bottom side. Therefore, random reflection of the light is not repeated therebetween. As a result, the light does not leak into an adjacent segment or the outside of the reflecting case.

In another embodiment of the light-emitting display device according to this invention, it is not required in the above configuration that the entire surface inclusive of the bottom other than the light conducting portions is colored in the light-absorptive color as long as the reflecting case is made of resin with the light-reflective color and at least the surface thereof on the side of a display surface is impregnated with dyes with a light absorptive color. In this configuration, even if the display surface is scratched and rubbed by a transfer case, the light absorptive color on the display surface does not disappear so that the whitish color is not exposed nor spotted. Specifically, since the resin is impregnated (dyed) with the light absorptive dyes to its interior, the dyes soak to a certain depth from the surface. Therefore, even if the flaw due to scratching is created on the display surface, the whitish color does not appear. Incidentally, the word "impregnation" means that the dyes soak to the depth of 10 $\mu$m or more from the surface of the resin to dye the resin.

In still another embodiment, the reflecting case may be made of resin with a light-absorptive color, and the inner walls of the light conducting portions may be processed in a light-reflective color. For this reason, revived resin can be used. The entire surface inclusive of the bottom other than the light conducting portions can also be colored in the light-absorptive color. Further, the diffraction of light can be prevented at the bottom. Moreover, since the reflecting case is made of the same dark color material to its interior, even if there is a deep flaw, the display surface is colored in the same color but not spotted. Additionally, the inner walls of the light-conducting portions can be colored in the light reflective color by spraying of whitish paint, non-electronic plating of e.g. Ag or impregnation of white dyes, etc.

The invention in which the surface of the resin with the light reflective color is colored in the light absorptive color by impregnation or the interiors of the light conducting portions in the resin with the light absorptive color is colored in the absorptive color can be employed.

The structure proposed according to this invention permits a person to know the direction of the light emitting display device from the outer shape of the reflecting case. The correct direction of the light emitting display device can be easily known through automatic recognition by a camera and the sense of touch by a man's hand. Therefore, the light emitting display device can be very easily mounted on a circuit board. Further, the uneven portions can be formed so that they have opposite steps on the upper and lower surfaces of the reflecting case or the left and right surfaces thereof. In this configuration, where the light emitting display devices are arranged vertically and/or horizontally, these steps are caused to overlap so that erroneous recognition of a exhibited numeral, which is attributed to leakage of light from the gap between adjacent light emitting display devices when light leaks to the rear surface of the reflecting case, does not occur. Further, uneven portions can be formed, for example, on the upper and lower surfaces thereof or the left and right surface thereof so that they are engaged with one or more linear projections formed on inner side walls of a tube which is used to transfer the light emitting display device. In this configuration, since the display screen of the light emitting display device is not rubbed within the tube, and leads are not housed within the tube so that the coating on the display screen will not be peeled.

For example, the reflecting case is substantially square in shape of the display screen of the display image, and the uneven portions are formed in such a manner that steps are formed at least left and right side walls thereof in a longitudinal direction of the display image so that the reflecting case can partially overlap an adjacent reflecting case between light emitting display devices arranged horizontally, or otherwise projections are formed at least on the upper and lower surfaces thereof or the left and right surface thereof in a longitudinal direction of the display image so that they are engaged with one or more linear projections formed on inner side walls of a tube which is used to transfer the light emitting display device. Incidentally, the left/right or upper/lower in a longitudinal direction of the display image means those in a state generally viewed when a numeral or character is displayed.

Preferably, the reflecting case is substantially square in shape of the display screen of the display image, and has uneven portions formed at least left and right side walls thereof in a longitudinal direction of the display image so that they can be fit into/over those of an adjacent reflecting case between light emitting display devices arranged horizontally. In this configuration, for example, where display device units are arranged to a single light emitting display device, the device units integrated by fitting between the uneven portions can be collectively mounted on the circuit board. This simplifies the mounting and interrupts light leakage from the boundary between adjacent light emitting display device units, thus improving the display quality.

Preferably, the plurality of leads are extended out from the upper surface and lower surface of the reflecting case in a longitudinal direction of the display image and bent at an approximately right angle to the surfaces of the leads to be bonded at their one ends and further bent so as to be substantially parallel to the surfaces at their other ends. In this configuration, the light emitting display device units which are arranged generally horizontally can be intimately arranged horizontally and the problem of contact between the leads does not entirely occur. For this reason, the light emitting display device can manufactured using a lead frame. In addition, where the tips (other ends) of the leads are bent for surface-mounting, the device can be formed into the surface-mounting type having a gull-wing shape in which the leads are bent outwardly but not inwardly (beneath of the resin). The leads can be also formed into a structure from which the state of soldering can be easily recognized. Incidentally, bending the leads at a substantially right angle to the surfaces of leads to be bonded does not mean to bend them at an accurate right angle, but the greater part of the leads in a bending direction is in the direction of the right angle.

DESCRIPTION OF THE PREFERRED EMBODIMENTS

Figure 1A:
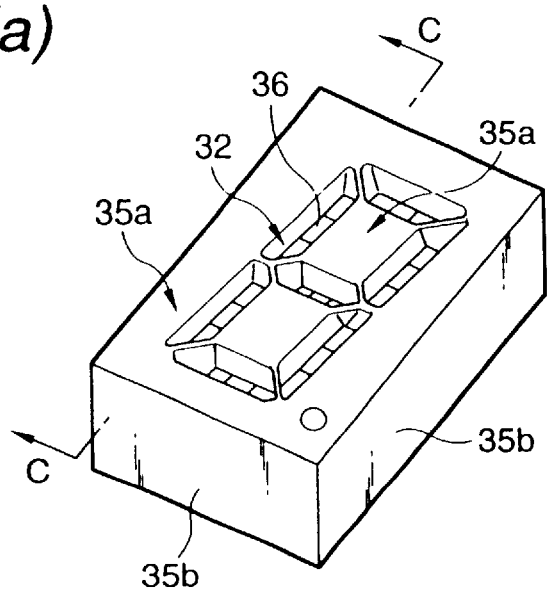
FIGS. 1(*a*) to 1(*c*) are to show a view for explaining an example of a reflecting case in the light emitting display device according to this invention.

Now referring to the drawings, an explanation will be given of a light emitting display device according to this invention.

Figure 1B:
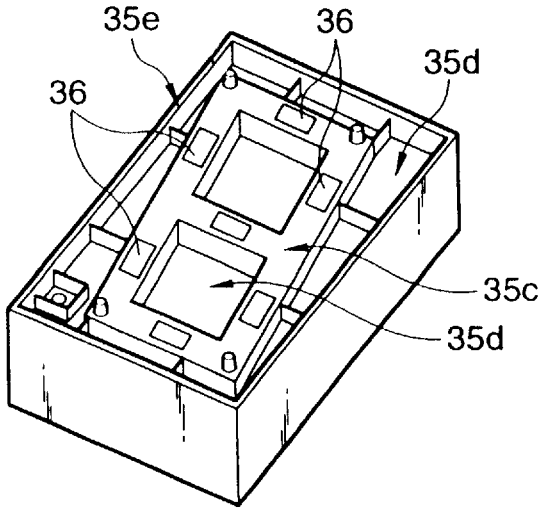
Figure 1C:
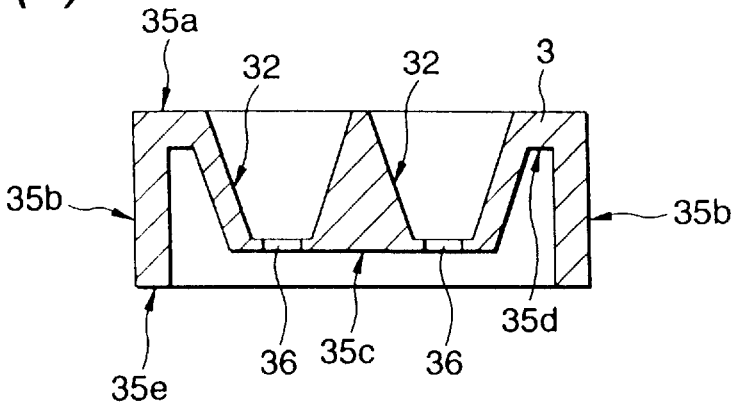
Figure 2A:
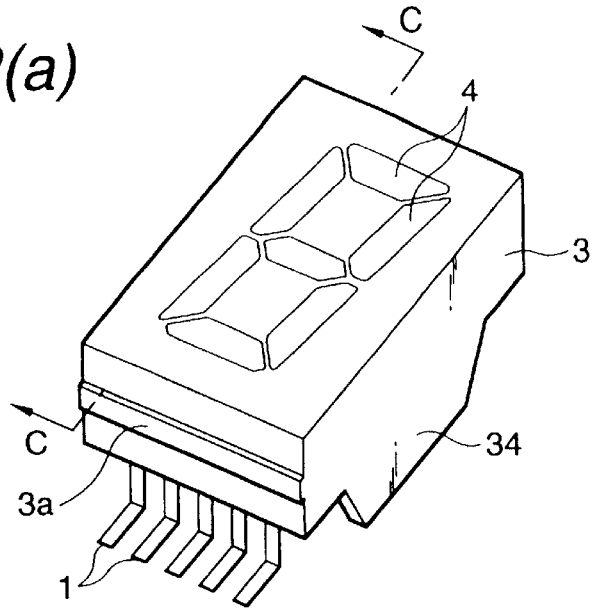
FIGS. 2(*a*) to 2(*c*) are to show a view showing an embodiment of the light emitting display device according to this invention.
Figure 2B:
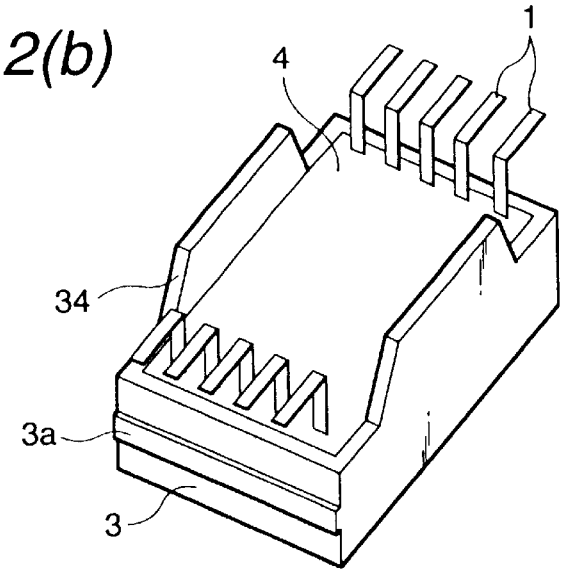
Figure 2C:
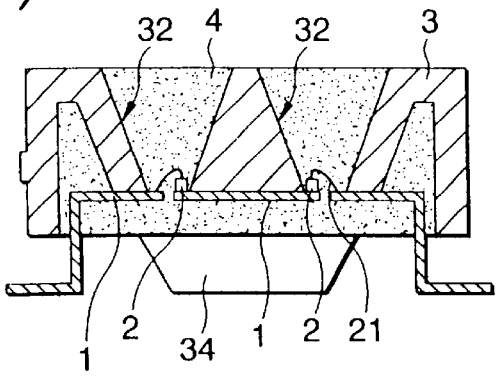

FIG. 1(*a*) is a front perspective view of an embodiment of the light emitting display device according to this invention. FIG. 1(*b*) is a bottom perspective view of the embodiment. FIG. 1(*c*) is a sectional view taken in line C—C in FIG. 1(*a*). As seen from these figurers, a light emitting element (LED chip) 2 is attached to the one end of each of leads 1 for segments constituting a numeral which is a part of a display image in such a manner that the LED chip 2 is die-bonded or wire-bonded to the one end of each lead 1, thereby constituting a display section. In a reflecting case, a light conducting portion 32 is formed so as to correspond to each of the segments which are a part of the display image. The light conducting portion 32 is located to encircle the LED chip 2. The reflecting case 3 is filled with a light-permeable resin 4 so that the interior of the light conducting portions 32 and the one sides of the plural leads 1 are fixed. This invention is characterized in that the reflecting case 3 is made of e.g. thermoplastic resin, and the inner wall of the light conducting portion 32 is colored in light-reflective color whereas the remaining outer surface inclusive of the bottom is entirely colored in light-absorptive color. In this invention, a projection is partially formed on the outer peripheral side wall of the reflecting case. In the example shown in FIGS. 2(*a*)–2(*c*), a convex portion 3*a* is formed on the upper and lower side walls, respectively.

The reflecting case 3 is an injection-molded product of thermoplastic resin such as highly heat-resistant "super-enpla" (e.g. liquid-crystal polymer). The outer shape of the display surface may be square. The heat-resistant resin is used so that the reflecting case can endure the temperature of "solder reflow". As seen from a front perspective view, a bottom perspective view and sectional view of (a) of FIGS. 1(*a*)–1(*c*), the reflecting case is integrally formed to provide a display surface 35*a*, side surfaces 35*b*, a bottom surface 35*c* which serves to hold a lead frame or resin circuit board, a bottom surface 35*e* at an outer peripheral wall, the remaining bottom surface 35*d*, light conducting portions 32 and through-holes 36 for placing the LEDs 2 inside the light conducting portions 32. The light conducting portion is tapered so that its size is smaller on the bottom side and larger on the side of the display surface. The light conducting portions 32 constitute a part of the display image.

As seen from FIGS. 1(*a*)–1(*c*), the display surface 35*a* of the side surface 35*b* are flat and can be coated relatively easily. Therefore, traditionally, the display surface 35*a*, and the side surface as necessary were coated with paint. On the other hand, the bottom surfaces, i.e. bottom surface 35*c* which holds the lead frame, other bottom surface 35*d* and bottom surface 35 at the outer peripheral wall have different heights and complicate shapes. These bottom surfaces cannot be coated with black by printing so that they were conventionally left white intactly. On the other hand, this invention is characterized in that these bottom surfaces 35*c*–35*e* as well as the display surface 35*a* and side surfaces 35*b* are colored in light-absorptive color such as black.

All the exposed surfaces other than the inner walls of the light-conducting portions 32 of the reflecting case 3 can be colored in blackish color as follows. The reflecting case 3 having the above structure is manufactured by integral molding using e.g. whitish light-reflective thermoplastic resin. Thereafter, the interiors of the light conduction portions 32 are filled with resist. The entire reflecting case is immersed in for about 15 minutes in a dying solution for the resin. As a result, the dyed soak to the depth of about 20 $\mu$m from the outer surface so that the reflecting case is dyed. Thereafter, the resist embedded in the light conducting portions 32 is removed by medicine treatment. In this way, with only the interiors of the light-conducting portions 32 whitish-colored, all the outer surfaces can be colored in the light-absorptive color such as black.

All the exposed surfaces other than the inner walls of the light-conducting portions 32 of the reflecting case 3 can be colored in blackish color by another technique. The reflecting case 3 having the above structure is manufactured by integral molding using e.g. blackish light-absorptive resin. Thereafter, with the entire outer surface other than the light conducting portions 32 masked with a resist film, the reflecting case is subjected to plating of whitish color such as Ag plating through non-electrolytic plating, dyed with white dyes in the same manner as described above, or sprayed with white dyes from the side of the display surface. Thereafter, the mask is removed so that the interiors of the light-conducting portions are whitish-colored and the remaining outer surfaces are blackish-colored.

Incidentally, the outer surface other than the interiors of the light-conduction portions 32 can be masked in such a manner that the interiors of the light conducting portions 32 are previously filled with a material which can be etched selectively from that for the mask material such as resist for the outer surface, and after the outer surface has been masked, the material filled in the light conducting portions 32 is removed.

Figure 3:
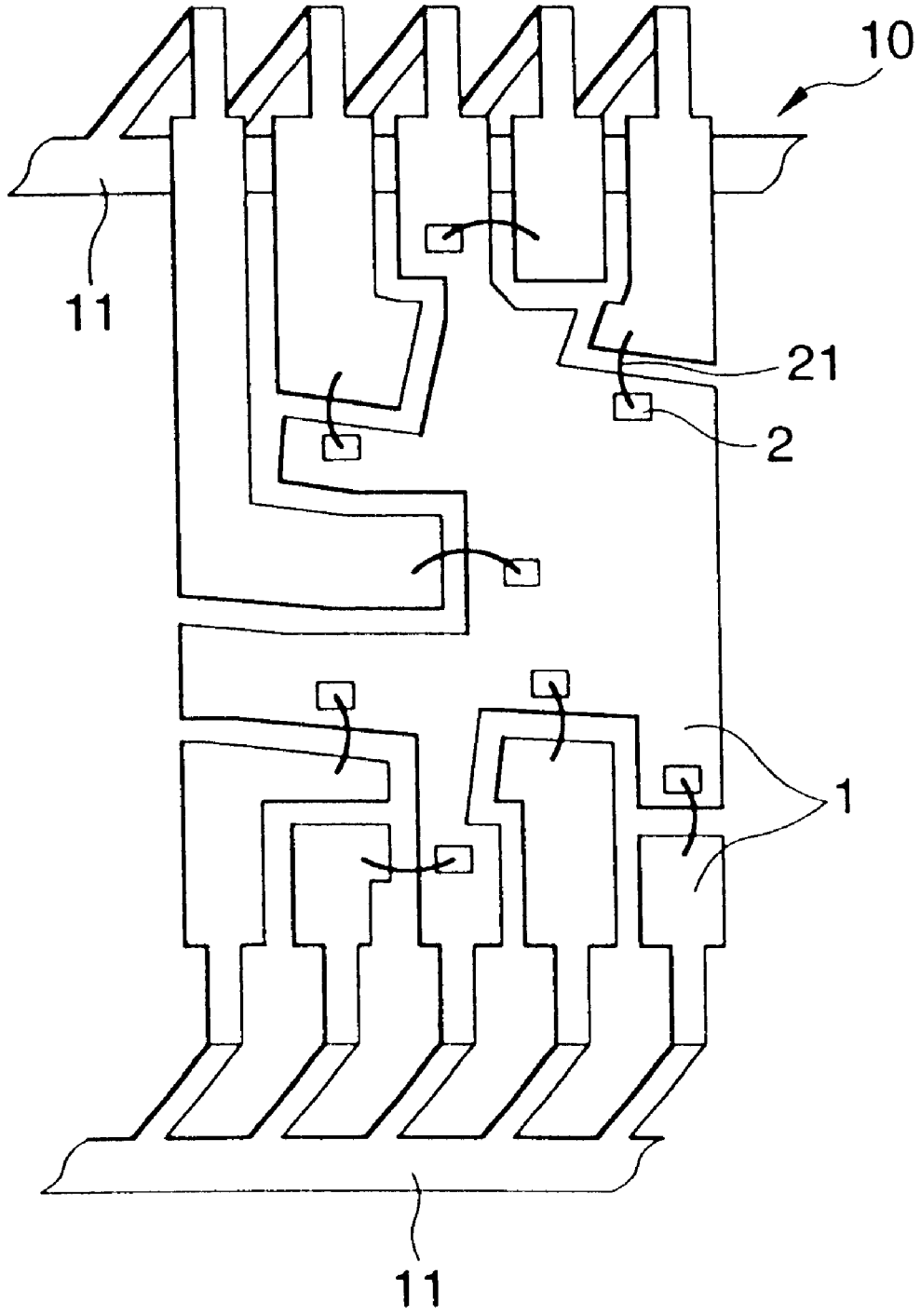
FIG. 3 is a view showing a typical lead frame for the display device shown in FIG. 2.

The light emitting portion has the same structure that of a conventional light emitting display device. The light emitting portion will be formed as follows. As seen from FIG. 2(*c*) which is a sectional view taken in line C—C of FIG. 2(*c*) and FIG. 3 showing an example of a lead frame, a side rail 11 of the lead frame 10 having a plurality of leads 1 are bent at a right angle. Thereafter, a plurality of LED chips 2 are die-bonded at the end of the single lead 1. The upper electrode of each LED chip 2
is wire-bonded to the one end of another lead 1 via a gold wire 21. Incidentally, in the example shown in FIG. 3, the lead frame is structured so that the leads 1 are extended in a longitudinal direction of a numeral to be displayed. The one electrodes of the LED chips 2 each constituting each segment are die-bonded to the same lead 1 to provide a common electrode. The other electrodes of the LED chips are wire-bonded to the different leads. This is reversible.

After the other ends of the leads have been fixed by light-permeable resin 4, they are separated from the lead frame 10. The leads 1 are further subjected to forming processing so that they are parallel to the bonding surface. The forming processing is executed so that the leads can be soldered to a circuit board by solder reflow while they are placed there. By the forming processing, the leads are bent to be substantially parallel to the bonding surface. The leads 1 take various shapes on the way as long as their tips are substantially parallel to the bonding surface. The leads with their tips bend outwardly from the reflecting case 3 takes a general gull-wing shape, but they may be bent inwardly.

The light emitting portions each is provided for each of the segments of a display image (numeral). The light emitting portions are covered with a reflecting case 3 so that these light emitting portions are stayed in the light conducting portions 32 which constitute the segments, respectively. The reflecting case 3 is an injection-molded product of thermoplastic resin such as highly heat-resistant "super-enpla" (e.g. liquid-crystal polymer) The outer shape of the display screen may be square. The heat-resistant resin is used so that the reflecting case can endure the temperature of "solder reflow". Incidentally, the display screen side (periphery of the light conducting portions (light emitting portions) of the seven segments) of the reflecting case 3 is coated with black in order to improve the visibility In the example shown in FIGS. 2(*a*)–2(*c*), on both sides of the reflecting case 3 from which the leads 1 are not extended, i.e. on both left and right sides in a display direction of the numeral, legs 34 are formed at their central positions. The legs 34 are not required to define the height of the display device, but are used for holding the display device for external force. Therefore, the legs 34 has a height or slightly lower (e.g. 0.5 mm) so that they are flush with the bent portions at the tips of the leads. Further, the legs are desired to be as wide as possible for stableness as long as they do not excessively approximate to the leads 1. However, the width should not be particularly limited.

The structure on the display screen side of the reflecting case 3 is the same as a conventional structure. Specifically, as seen from FIG. 2(*c*), the display screen is formed in the structure in which the light conducting portions 32 are located to constitute parts of a display image such as segments. A lead frame with light emitting portions is inserted in the reflecting case so that the light emitting portions are stayed inside the light conducting portions 32. Light-permeable resin 4 is filled in the interior of the lead frame and in the reflecting case 3 at the bonding portions of the respective leads. The light-permeable resin 4 is not necessarily transparent but may any material capable of transmitting light. For example, where an LED chip 2 emitting red light is used as the light emitting portion, the light permeable resin mixed with red dyes does not interrupt red light. Such resin is convenient to cause a person to recognize a red light emitting display device while the display device does not make exhibition.

An explanation will be given of a method of manufacturing the light emitting display device. First, a leas frame is formed so that an arrangement pattern of LED chips 2 constitutes parts (segments) of a display image as shown in FIG. 3 and all leads 1 are extended out from the upper and lower parts of the display image. As seen from FIG. 3, the side rails 11 on both sides of the lead frame are bent so that they form a right angle with a bonding surface. The LED chips are die-bonded and the upper electrodes thereof are wire bonded. Thereafter, the light conducting portions for the segments are formed. In order to prevent leakage of resin, a tape is put on the display screen side of the reflecting case 3 with a projection formed on its outer periphery. The reflecting case 3 is turned over. The bonding portion of the lead frame with the LED chips bonded thereon is inserted into the reflecting case 3. The resin is filled into the reflecting case. The lead frame may be inserted after the resin has been filled.

Thereafter, resin is hardened by heating. The side rails 11 of the lead frame are cut away so that the leads are separated from one another. A jig is inserted in the stem of each lead 1 which is exposed from the light permeable resin 4 so that the lead 1 is fixed and its tip is bent. Since the lead is bent while being fixed by the above jig, a crack is not generated in the light permeable resin, and the lead can be bent always at a predetermined position.

In this embodiment, the lead frame was used for the light-emitting display device. Instead of it, a resin circuit board may be used. In this case, the LED chips are first bonded to the resin circuit board. Thereafter, the reflecting case as well as the light-permeable resin is fixed to the resin circuit board. Finally, the resin circuit board is cut into the individual light emitting display devices.

In accordance with this invention, the reflecting case is colored to the bottom side in the light absorptive color which does not permit to light to be reflected. Therefore, even when light leaks via the light-permeable resin toward the bottom of the reflecting case and reflects from the plane of the lead frame, it does not reflect from the bottom of the reflecting case. Therefore, random reflection of the light is not repeated therebetween. As a result, the light does not leak into an adjacent segment or the outside of the reflecting case so that the segment not desired is not lit. Erroneous display of apparently displaying "1" due to light leakage from the gap generated in the light-emitting display device does not occur.

Even where the display surface of the reflecting case made of whitish resin is not flat and includes burrs and uneven spots, it can be blackish-colored uniformly in such a manner that it is impregnated with the blackish light absorptive dyes unlike the conventional coating by ink printing on the surface. In this case, the dyes are not only applied to the surface but also soak the inside. For this reason, even when the display surface is scooped out due to a flaw, the inner dyed portion appears so that the flaw is not conspicuous. This greatly increases the reliability of the display surface. Further, using this technique of impregnation, the portion of the bottom of the reflecting case which is not flat can be easily colored in black. Thus, the entire surface of the reflecting case other than the light conducting portions can be easily cooler in black.

Further, the above technique can be replaced by coloring only the interiors of the light conducting portions in white in the reflecting case formed of blackish resin. In this case, the lighting portions such as the segments in which light is not absorbed but reflected can be lit with high brightness. In addition, since the remaining outer surface and inside are entirely colored in black, the appearance of the reflecting case, even when the flaw is made, is not impaired. The erroneous display due to the light leaked on the side of the bottom can be also avoided. Further, where the reflecting case is made of the blackish resin, the revived product can be used as resin material. Therefore, the resource can be effectively used.

In the embodiments described above, the light-emitting display device was designed in a gull-wing surface-mounted structure in which the respective leads are extended vertically in a longitudinal direction of the display surface and their tips are bent outwardly. This invention can be also applied to the structure in which the leads are extended from the left and right sides, and to the surface-mounted structure in which the tips of the leads are bent inwardly. Further, this invention can be applied to the conventional reflecting case in which the leads are straight.

In accordance with this invention, since an uneven portion of projection is formed on e.g. the lower side of the reflecting case but is not formed on the upper outer peripheral wall thereof, the vertical direction of the reflecting case can be easily known automatically or by the sense of touch of a man. As a result, with no error of knowing the direction, the reflecting case can be mounted accurately and easily. In the example shown in FIGS. 2(*a*)–2(*c*), using the lead frame, the leads are extended out from the upper and lower side of in a longitudinal direction of display of e.g. a numeral. Therefore, where the display device is used in a state where its plural device units are arranged side by side, an interference accident that leads are brought into contact with each other between the adjacent display device units will not occur. Thus, the tips of the leads are formed in a gull-wing shape, and hence in mounting, the leads can be easily soldered without being inserted into through-holes of a circuit board.

Incidentally, where the tips of the leads are bent outwardly from the reflecting case, the position of soldering can be known at a glance. Where the tips of leads are bent inwardly from the reflecting case, the display device units can be arranged not only horizontally but also vertically, thereby realizing compact mounting. Further, in the light emitting display device, generally, the light permeable is fragile and is apt to crack. The crack deteriorates the display state. The forming of the leads with their stems being fixed does not arise such a problem.

Figure 4A:
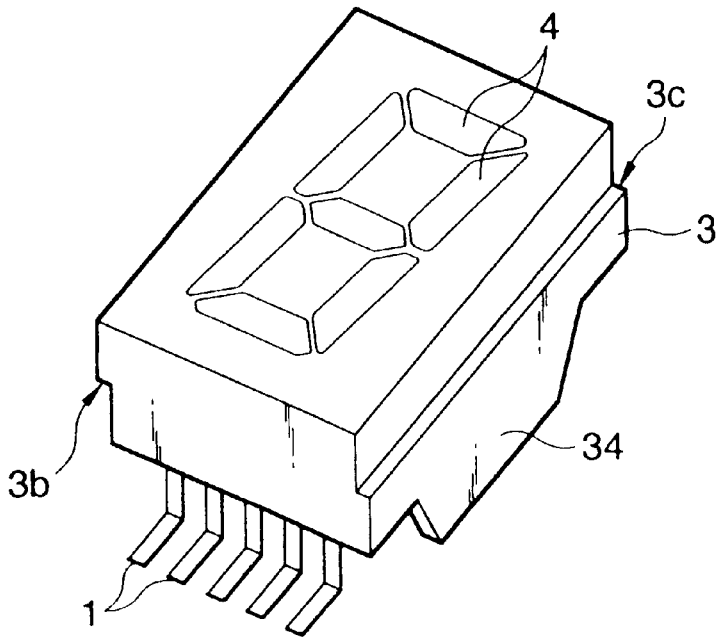
FIGS. 4(*a*) and 4(*b*) are to show an example of another embodiment of the light emitting display device according to this invention.
Figure 4B:
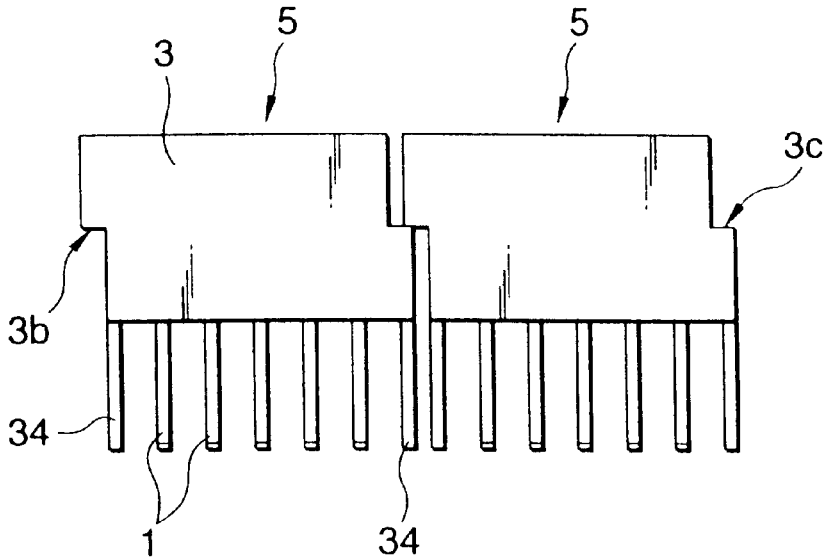

FIGS. 4(*a*)–4(*b*) show a state where the uneven portion formed on the outer peripheral wall of the reflecting case 3 has steps 3*b* and 3*c* on the left and right walls thereof in the longitudinal direction of display, and the steps 3*b* and 3*c* overlap each other when the display device units are arranged side by side horizontally. In such a shape also, the lower step (projection) 3*c* designates the right side so that the direction can be discriminated easily. Incidentally, in FIGS. 4(*a*)–4(*b*), like reference numerals referring to like parts in FIGS. 2(*a*)–2(*c*) are not explained here.

Meanwhile, as seen from FIG. 4(*a*), where the light emitting display device is a numeral indicator, in order to increase of the number of digits to be exhibited, in most cases, various display device units are arranged side by side horizontally. In such a case, the light leaked to the bottom side of the resin 4 may leak toward the display screen side via the gap between the adjacent display device units. However, the step portions 3*a* and 3*c* formed as seen from FIG. 4(*a*) can be arranged to overlap each other as seen from FIG. 4(*b*). Because of such overlapping arrangement, the light leaked to the bottom is interrupted at the gap by the step portion 3*b* so that the light does not leak toward the display screen side via the gap. This improves the display quality greatly. In the example shown in FIGS. 4(*a*)–4(*b*), such step portions are formed on the left and right side walls in the longitudinal direction of display. However, where the display device units are arranged vertically, the step portions are preferably formed on the upper and lower side wall in a vertical direction.

Figure 5A:
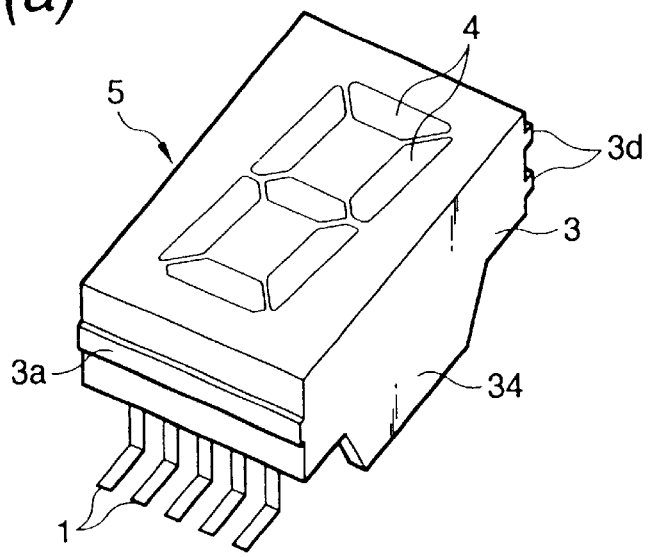
FIGS. 5(*a*) to 5(*c*) are to show a view for explaining still another embodiment of the light emitting display device according to this invention.
Figure 5B:
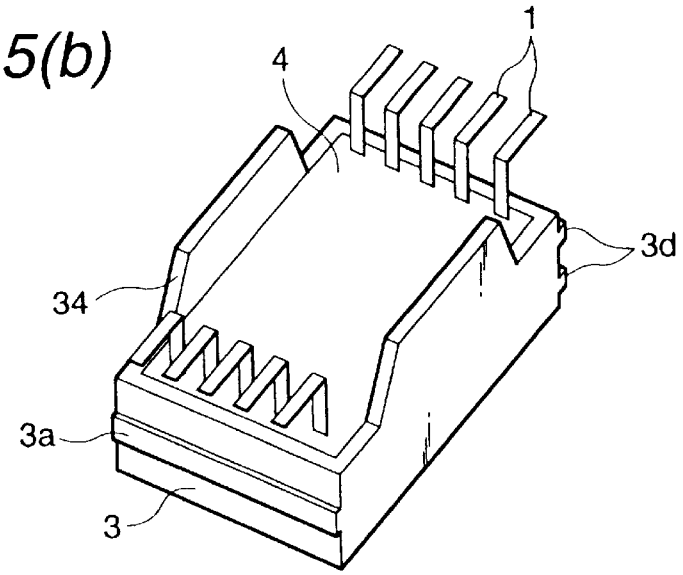
Figure 5C:
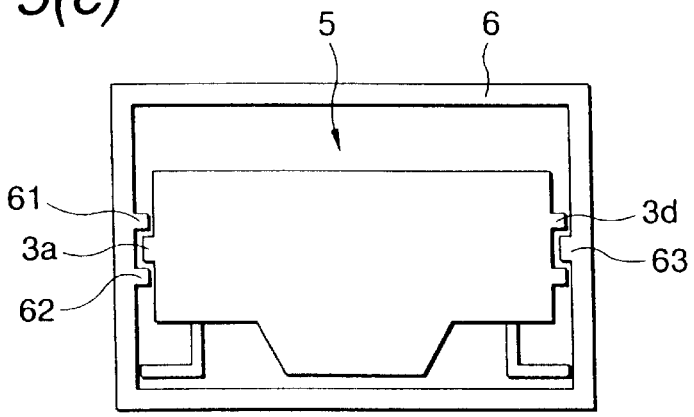

FIGS. 5(*a*)–5(*c*) show an example where projections 3*a* and 3*d* are formed on the upper and lower outer peripheral walls of the reflecting case 3. In this example, two projections 3*d* are formed on the upper outer peripheral wall whereas a single projection 3*a* is formed on the lower outer peripheral wall. Because of such a configuration, the vertical direction of the light-emitting display device can be known from the number of the projections. Incidentally, in FIGS. 5(*a*)–5(*c*), like reference numerals referring to like parts in FIGS. 2(*a*)–2(*c*) are not explained here.

Meanwhile, the light emitting display device at issue is transferred in a state where several tens of display device units are inserted in a long slender plastic tube. In this case, they are supported at the ends on the display screen side of the reflecting case and the ends on the bottom side thereof. This arises a problems that the ends of the display screen are rubbed and black paint coated on the display screen is peeled, thereby deteriorating the display quality. However, in accordance with the example shown in FIGS. 5(*a*)–5(*c*), as seen from FIG. 5(*c*) which is a sectional view of the light emitting display device 5 inserted in the tube, the projection 3*a* formed on the lower outer peripheral wall of the reflecting case is sandwiched between projections 61 and 62 formed on an inner wall of the tube 6 whereas the projections 3*d* formed on the upper outer peripheral wall fit over a linear projection 63 formed on another opposite inner wall of the tube 6. Thus, the light emitting display device can be supported at the positions of the side walls of the reflecting case which is not entirely related to the display screen.

Figure 6A:
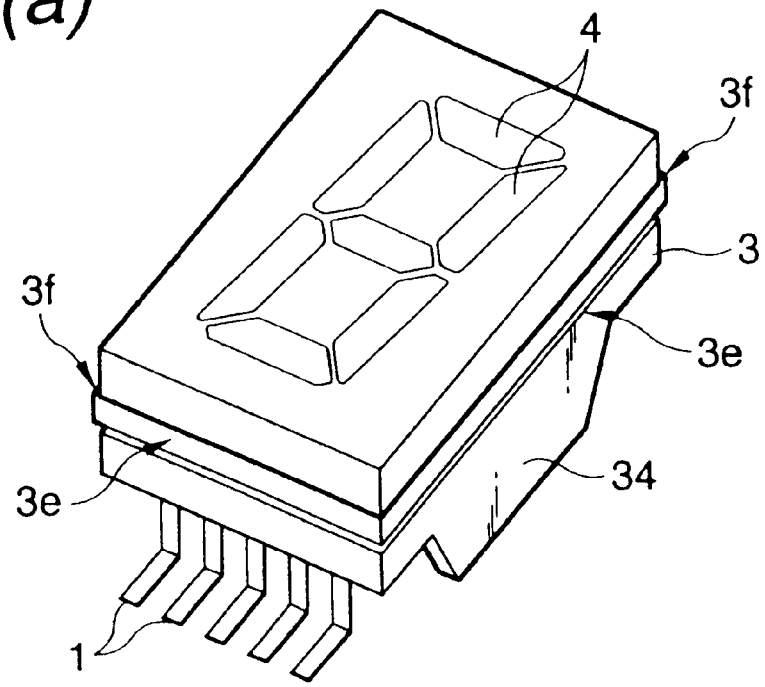
FIGS. 6(*a*) and 6(*b*) are to show a view for explaining a further embodiment of the light emitting display device according to this invention.
Figure 6B:
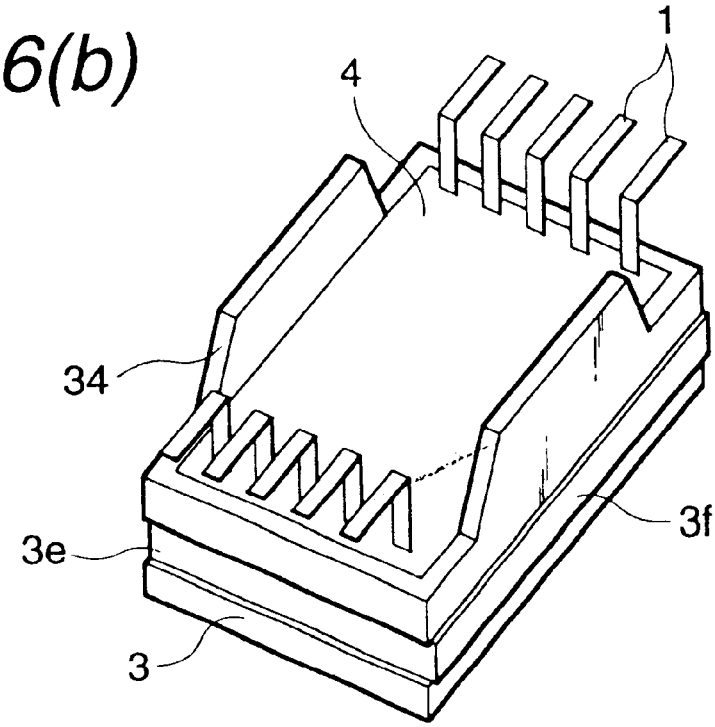

FIGS. 6(*a*)–6(*b*) show still another embodiment having a modified shape of an uneven portion. In this embodiment, the intermediate portion of the reflecting case 3 is formed to deviate vertically and horizontally. Specifically, in the example shown in FIGS. 6(*a*)–6(*b*), at the intermediate portion of the reflecting case 3, the upper side is formed as a convex portion 3*f* whereas the lower side is formed as a concave portion 3*e*. Further, the left side is formed as the convex portion 3*f* whereas the right side is formed as the concave portion 3*e*. By knowing the convex portion on the upper or left side, the direction of the reflecting case can be known immediately. On the other hand, where plural light emitting display device units are to be arranged vertically or horizontally, the convex portion 3*f* and concave portion 3*e* of the adjacent light-emitting display device units can be coupled with each other. Therefore, the numeral indicators corresponding to the number of necessary digits can be previously coupled to provide an integral body which can be directly mounted on e.g. a circuit board.

Additionally, if the convex portion 3*f* and concave portion 3*e* are tapered as necessary, they can be coupled with each other more firmly. In the example as shown, the tips of the leads extended out vertically are bent outwardly in a gull-wing shape. However, where the display device units are to be arranged in both vertical and horizontal directions, the tips of the leads extended out vertically must be bent inwardly. On the other hand, where the display device units are to be arranged only horizontally, this is not required. In addition, the convex and concave portions have only to be formed only horizontally. Further, the coupling structure permits can interrupt the light leakage between the adjacent light emitting display device units and prevent erroneous exhibition due to the light leakage. Incidentally, in FIGS. 6(*a*)–6(*b*), like reference numerals referring to like parts in FIGS. 2(*a*)–2(*c*) are not explained here.

Figure 7:
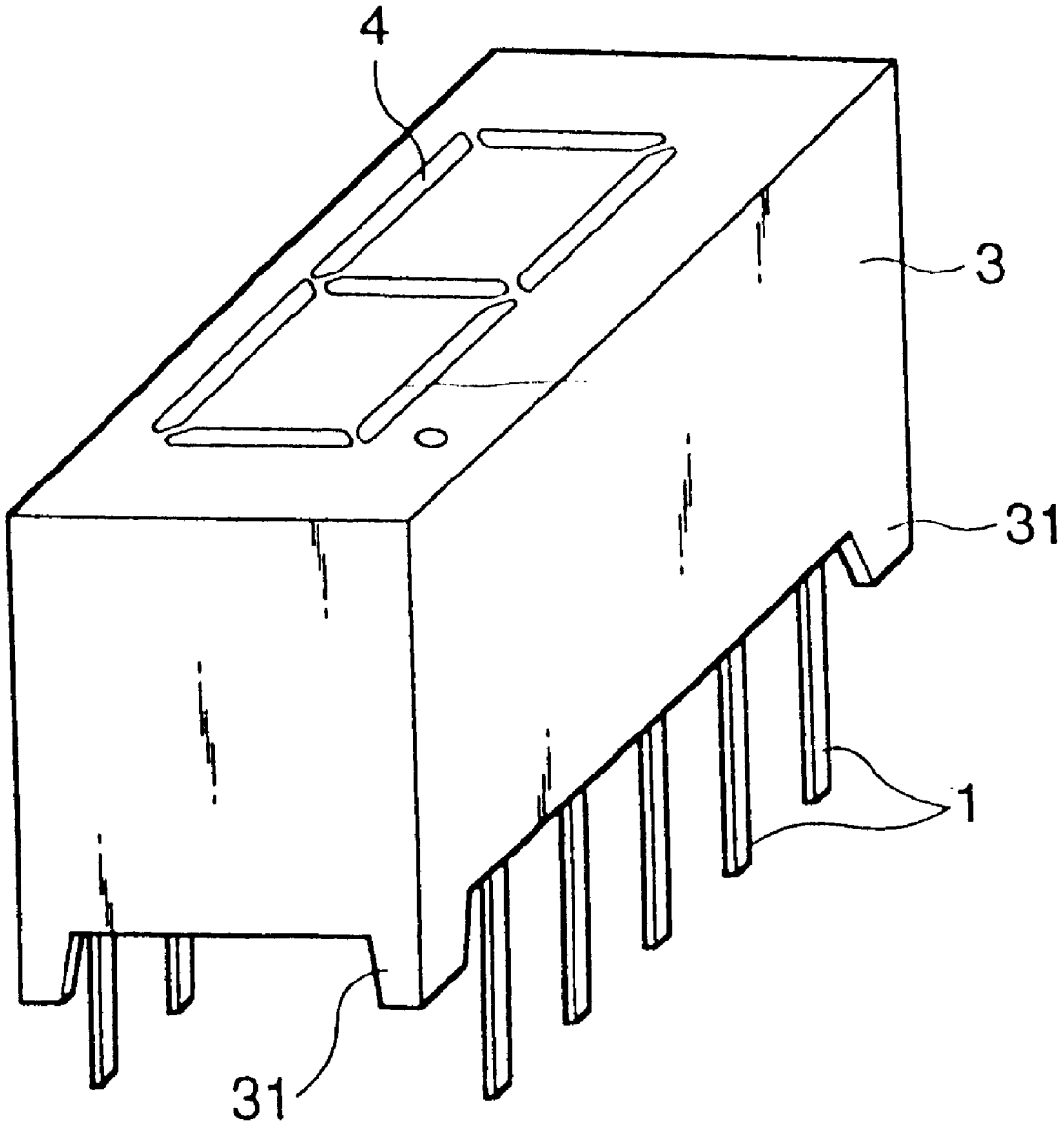
FIG. 7 RELATED ART
FIG. 7 is a perspective view for explaining a conventional light emitting display device.

In the respective examples described above, the invention has been applied to the light emitting display device in which the leads are extended out vertically in a longitudinal direction of the display screen. However, this invention can be applied to the light emitting display device in which the leads are extended out horizontally. Further, in the light emitting display device having a conventional structure as shown in FIG. 7, the vertical direction of the device can be easily known by provision of the uneven portion formed on the outer peripheral wall of the reflecting case.

In this invention, there can be provided a reliable light-emitting display device which is free from deterioration of display quality due to coating peeling on the display surface and erroneous display due to light leakage from the bottom. Since revived products can be used as blackish resin, the light emitting display device with high quality can be manufacture while the resource is efficiently used.

Further, in this invention, the vertical direction of the light emitting display device which is apt to be substantially symmetrical with respect to a point in an outward appearance, can be known easily. This greatly facilitates mounting of this device to a circuit board. Further, the uneven portion is formed as a step, formed to correspond so as to the projection(s) in the tube for transfer, or formed so that the adjacent display device units are coupled with each other. Therefore, the erroneous exhibition due to the light leakage from the gap between the adjacent light emitting display device units can be prevented and occurrence of the flaw on the display screen during transfer can be prevented.

Still further, since the tips of the leads extended out vertically are bent to be parallel to a bonding plane, the light emitting display device can be manufactured at low cost using a lead frame. In addition, in mounting the display device units arranged horizontally, since they are manufactured in a surface mounting type, they can be mounted in a circuit board by an automatic machine. This permits the display device units to be mounted on the circuit board with high productivity and at low cost. Further, in soldering of the leads into the through-holes, incomplete soldering due to a large gap between the respective leads and through-holes can be prevented, thereby improving the reliability of soldering.

What is claimed is:

1. A Light emitting display device comprising:

a plurality of light-emitting elements for lighting corresponding portions of a display image, respectively;

a plurality of leads having at least one end to which at least one of said light emitting elements is one of die-bonded and wire-bonded;

a reflecting case which has light conducting portions that are located adjacent said light emitting elements corresponding to the corresponding portions of the display image; and a light permeable resin is located in said reflecting case such that the at least one end of said plurality of leads is fixed, wherein said reflecting case is made of resin, and said light conducting portions are colored in a light-reflective color and an outer surface of the reflecting case is colored in light-absorptive color.

2. A light emitting display device comprising:

a plurality of light-emitting elements for lighting corresponding portions of a display image, respectively;

a plurality of leads with at least one end to which at least one of said light emitting elements is one of die-bonded and wire-bonded;

a reflecting case which has light conducting portions that are located adjacent said light emitting elements corresponding to the corresponding portions of the display image; and a light permeable resin located in said reflecting case such that the at least one end of said plurality of leads is fixed, wherein said reflecting case is made of resin with a light-reflective color, and at least a surface adjacent to the display image is impregnated with dyes with a light absorptive color.

3. A light emitting display device comprising:

a plurality of light-emitting elements for lighting corresponding portions of a display image, respectively;

a plurality of leads having at least one end to which at least one of said light emitting elements is one of die-bonded and wire-bonded;

a reflecting case which has light conducting areas that are located adjacent said light emitting elements corresponding to the corresponding portions of the display image; and a light permeable resin is located in said reflecting case such that the at least one end of said plurality of leads is fixed, wherein said reflecting case is made of resin with a light-absorptive color, and said light conducting areas have a light-reflective color.

4. A light emitting display device according to claim 1, wherein said reflecting case is made of resin with a light reflective color and a surface other than inner walls of the light-conducting portions of said reflecting case is impregnated with dyes with light absorptive color, or otherwise said reflecting case is made of resin with light absorptive color and the inner walls of the light-conducting portions of said reflecting case include light reflective color.

5. A light emitting display device comprising:

a plurality of light-emitting elements for lighting corresponding portions of a display image, respectively;

a plurality of leads having at least one end to which at least one of said light emitting elements is one of die-bonded and wire-bonded;

a reflecting case which has light conducting portions that are located adjacent said light emitting elements corresponding to the corresponding portions of the display image; and a light permeable resin is located in said reflecting case such that the at least one end of said plurality of leads is fixed, wherein a step portion is formed on at least an outer peripheral side wall of said reflecting case.

6. A light emitting display device according to claim 5, wherein said reflecting case is substantially rectangular in shape, and has the step portion formed at least on a left and a right side wall with respect to the longitudinal direction of the display image so that said reflecting case can partially overlap an adjacent reflecting case arranged horizontally.

7. A light emitting display device according to claim 5, wherein said reflecting case is substantially rectangular in shape, and has projecting portions formed at least on one of an upper and a lower surface, and the left and right surfaces with respect to the longitudinal direction of the display image so that the projecting portions are engaged with one or more linear projections formed on an inner wall of a tube which is used to transfer the light emitting display device.

8. A light emitting display device according to claim 5, wherein said reflecting case is substantially rectangular in shape and has convex and concave portions formed at least on an upper and a lower wall respectively formed on the left and right side walls respectively with respect to the longitudinal direction of the display image so that the convex and concave portions can be fit into/over those of an adjacent reflecting case arranged horizontally.

9. A light emitting display device according to claims 5, 6, 7 or 8, wherein said plurality of leads extend from the lower surface of said reflecting case, said plurality of leads may be bonded at a second end and said plurality of leads are bent at approximately a right angle so as to be substantially parallel to said surfaces.

* * * * *